US010968694B2

(12) United States Patent
Bohlen et al.

(10) Patent No.: US 10,968,694 B2
(45) Date of Patent: Apr. 6, 2021

(54) MOUNTING SYSTEM FOR AN ARCHITECTURAL COVERING AND AN END BEARING FOR THE MOUNTING SYSTEM

(71) Applicant: Hunter Douglas Industries B.V., Rotterdam (NL)

(72) Inventors: Jorg Bohlen, Rotterdam (NL); Lars Koop, Rotterdam (NL)

(73) Assignee: Hunter Douglas Industries B.V., Rotterdam (NL)

( * ) Notice: Subject to any disclaimer, the term of this patent is extended or adjusted under 35 U.S.C. 154(b) by 284 days.

(21) Appl. No.: 15/938,113

(22) Filed: Mar. 28, 2018

(65) Prior Publication Data

US 2018/0258694 A1 Sep. 13, 2018

Related U.S. Application Data

(63) Continuation of application No. 14/759,702, filed as application No. PCT/NL2014/000002 on Jan. 2, 2014, now Pat. No. 9,957,752.

(30) Foreign Application Priority Data

Jan. 9, 2013 (NL) ..... 1039990
May 2, 2013 (NL) ..... 1040194

(51) Int. Cl.
*E06B 9/42* (2006.01)
*E06B 9/50* (2006.01)

(52) U.S. Cl.
CPC . *E06B 9/42* (2013.01); *E06B 9/50* (2013.01)

(58) Field of Classification Search
CPC ..... E06B 9/40; E06B 9/50; E06B 9/42; E06B 9/174

(Continued)

(56) References Cited

U.S. PATENT DOCUMENTS 267,403 A * 11/1882 Clemons ..... E06B 9/50 248/267
756,238 A 4/1904 Jackson
(Continued)

FOREIGN PATENT DOCUMENTS

DE 3338515 5/1985
DE 3338515 A1 * 5/1985 ..... E06B 9/44
(Continued)

OTHER PUBLICATIONS

Patent Cooperative Treaty (PCT) PCT International Search Report and Written Opinion for International Application No. PCT/NL2014/000005, dated Apr. 17, 2014 (9 pages).

*Primary Examiner* — Daniel P Cahn
*Assistant Examiner* — Jeremy C Ramsey
(74) *Attorney, Agent, or Firm* — Dority & Manning, P.A.

(57) ABSTRACT

The invention relates to a mounting system for an architectural covering comprising a roller and a bearing for rotatably mounting the roller to a holding member. The bearing comprises a length variation member which is biased to be in a first state yielding a bearing length which allows the roller to be held by the holding member, and which can be manipulated into a second state, in which the bearing length is reduced such that the roller is removable from the holding member. The length variation member comprises at least one sloped portion that extends along at least part of its outer circumference and in the first state extends largely or completely outside the roller. The sloped portion is dimensioned such that the length variation member can be urged to the second state by applying a force on the sloped portion in a single direction.

21 Claims, 9 Drawing Sheets

(58) Field of Classification Search
USPC ..... 248/266–272
See application file for complete search history.

(56) References Cited

U.S. PATENT DOCUMENTS

| | | | | |
|---|---|---|---|---|
| 1,090,931 | A * | 3/1914 | McLean | E06B 9/60 160/313 |
| 1,149,993 | A | 8/1915 | Bundy et al. | |
| 3,279,529 | A * | 10/1966 | Smith | E06B 9/40 160/323.1 |
| 3,853,170 | A | 12/1974 | Barettella | |
| 4,220,367 | A | 9/1980 | Gale et al. | |
| 4,399,857 | A * | 8/1983 | Honma | E06B 9/50 160/323.1 |
| 5,029,629 | A | 7/1991 | Cheng-Pei | |
| 7,740,047 | B2 | 6/2010 | Koop et al. | |
| 2008/0142171 | A1* | 6/2008 | Koop | E06B 9/50 160/243 |
| 2012/0067530 | A1* | 3/2012 | Barnes | E06B 9/50 160/326 |
| 2014/0190642 | A1* | 7/2014 | Chou | E06B 9/50 160/323.1 |
| 2019/0024450 | A1* | 1/2019 | Ng | E06B 9/50 |

FOREIGN PATENT DOCUMENTS

| | | |
|---|---|---|
| EP | 0046948 | 3/1982 |
| EP | 1936106 | 6/2008 |
| WO | WO 2010139945 | 12/2010 |

* cited by examiner

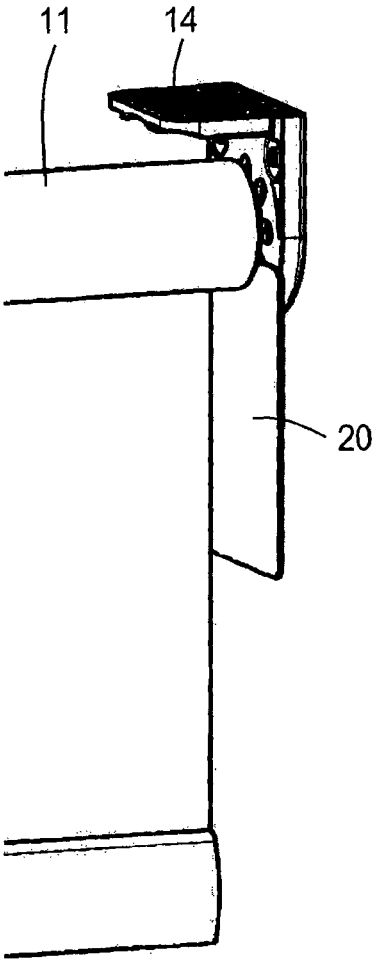
Fig.6A
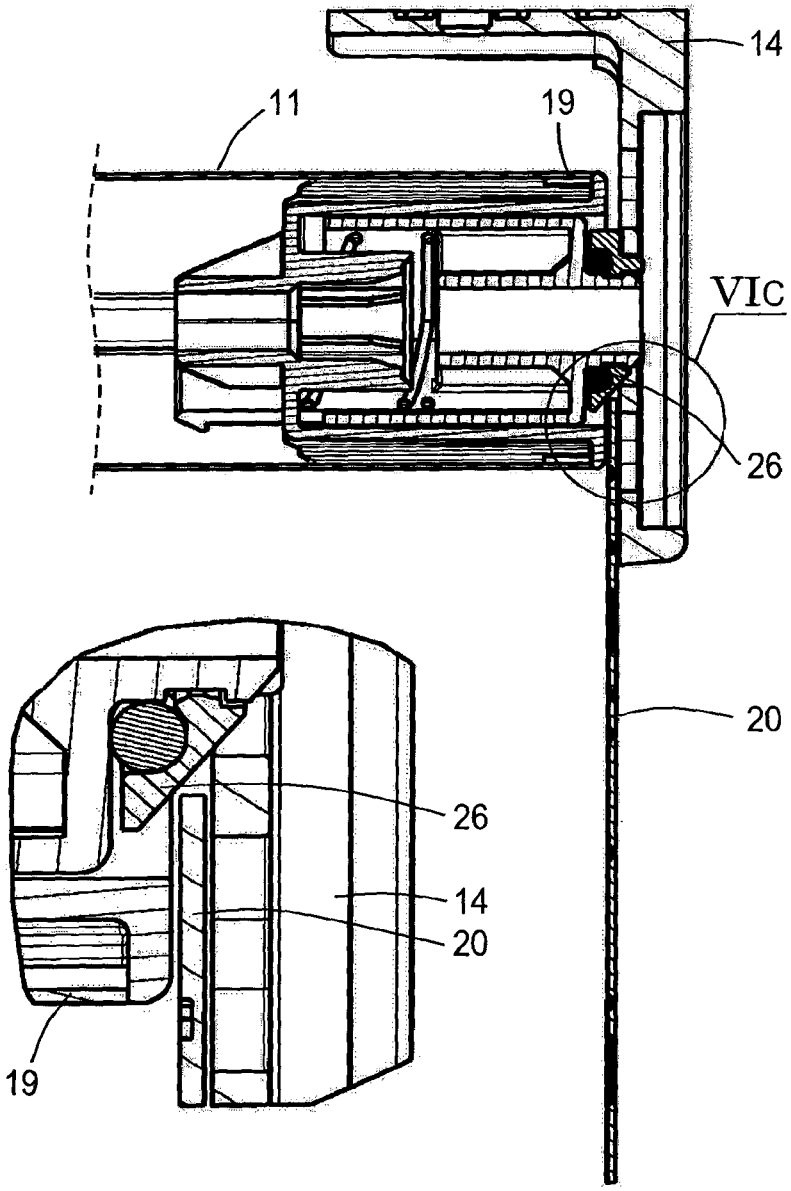
Fig.6B
Fig.6C

MOUNTING SYSTEM FOR AN ARCHITECTURAL COVERING AND AN END BEARING FOR THE MOUNTING SYSTEM

CROSS-REFERENCE TO RELATED APPLICATIONS

This application is a continuation of and claims the right of priority to U.S. patent application Ser. No. 14/759,702, filed Jul. 8, 2015, which is a national stage entry of International Patent Application No, PCT/NL2014/000002, filed Jan. 2, 2014, which, in turn, is based upon and claims priority to both Netherlands Patent Application No. 1040194, filed May 2, 2013, and Netherlands Patent Application No. 1039990, filed Jan. 9, 2013, the disclosures of all of which are hereby incorporated by reference herein in their entirety for all purposes.

TECHNICAL FIELD

This invention relates to a mounting system for an architectural covering as well as parts of the mounting system.

BACKGROUND

EP 1 936 106 A2 describes a mounting system for a covering for an architectural opening such as a window or door opening. The system includes a roller for winding and unwinding cover material, a telescopic end plug and two holding brackets. The telescopic end plug is received into an end portion of the roller and includes a telescopically movable member that is axially displaceable between an extended position in which it engages one of the holding brackets, and a retracted position in which it is disengaged from said bracket. With this mounting system, the covering can be mounted and dismounted very easily and efficiently.

To demount the roller from the brackets a tool such as a screw driver, needs to be inserted between the roller and the bracket to engage the telescopic member. The screw driver can subsequently be used as a lever, to urge the telescopic member into the roller. To allow for the introduction and manipulation of the tool there must be a relatively large gap between the roller and the holding bracket. Alternatively, part of the roller end may be broken away, to give access and space for the tool. Both solutions may result in openings or gaps between the covering and the architectural opening through which undesired light may pass.

It is an object of this invention to provide a mounting system for an architectural covering, that allows easy mounting and demounting of the covering, while at the same time allows for the aforementioned light gaps to be minimized. It is also an object of this invention to provide an end bearing for a mounting system which allows an architectural covering to be readily mounted and demounted with a minimal light gap between covering and architectural opening.

SUMMARY

The objects are achieved by the invention by virtue of the features of one or more of the appended claims.

The invention provides a mounting system for an architectural covering comprising a-roller for winding and unwinding a flexible member of the covering, such as a covering member and/or a lift cord, and an end bearing that is connected or connectable to an axial end portion of the roller for mounting the roller to a holding member. The end bearing comprises a length variation member, which is biased to be in a first state yielding a bearing length which allows the roller to be held by the holding member, and which can be manipulated into a second state, in which the bearing length is reduced such that the roller is removable from a holding member. The length variation member further comprises at least one sloped portion that extends along at least part of the length variation members' outer circumference and in the first state extends largely or completely outside the roller. The sloped portion is dimensioned such that the length variation member can be urged to its second state by applying a force on the sloped portion in one single direction. In other words, the angle under which the force is applied to the sloped portion can be kept constant during the manipulation of the length variation member from its first to its second state.

Thus, a user may demount the roller by pressing a tool against the sloped portion, thereby exerting a force on said sloped portion in a first direction.

Thanks to the sloped geometry, this force will have a force component that starts urging the length variation member towards its second state, against the biasing force. To complete the retracting movement of the length variation member it suffices to continue urging the tool against the sloped outer surface position in the same first direction. This will cause the end of the tool to slide along the sloped portion. It will be appreciated that the space needed to operate the tool can be minimal. Ideally, it corresponds to or is just slightly larger than the outer dimensions of the tool. No extra space is needed to change the angle of the tool or move it in any direction other than said first direction. It will further be appreciated that the required space for operating the tool can be further reduced by minimizing the dimensions of the tool itself.

Since the tool will only need to transmit a pressure force and will barely be exposed to bending forces or torques during use, it may be designed as a simple straight thin object, such as for instance a credit card.

Thanks to such a thin tool and the limited space needed to manipulate the tool, a gap between the roller and the holding member for accessing the sloped portion of the length variation member can be much smaller than with conventional mounting systems. Said gap may for instance have a width of less than 3 mm, and may preferably have a width of 2 mm or less. In fact, it may be beneficial to make the gap as small as possible so as to bear against the tool during use, thus supporting the tool against buckling.

The force needed to urge the length variation member towards its first state will depend on the biasing force that has to be overcome, the angle of the sloped portion and/or the direction of the force exerted on the sloped portion. The force may for instance be exerted on the sloped portion in a direction perpendicular to a centre axis of the roller. The biasing force may for instance range from about 10 N to about 20 N. The required operating force may for instance be a factor 2 or 3 higher, depending on aforementioned parameters. With such operating forces the tool can be of relatively thin dimensions.

As mentioned above, a suitable tool can for instance be formed by a credit card or a similar thin object. Such a card can be slid in between the roller and the holding member so as to have its edge abut the sloped portion of the length variation member. The gap between the roller and the holding may have a width that is just a fraction larger than the width of the credit card.

According to an aspect of the invention, the sloped portion extends up to the outer end of the length variation member, that is, the end of the length variation member that faces away from the roller. Thanks to such geometry, the tool can slide along the sloped portion till it reaches the end of the length variation member. Accordingly, an operating force can be exerted on the length variation member until the stage where the length variation member becomes disengaged from the holding member. The tool can then be urged further in the same direction so as to extend between the end of the length variation member and the holding member, thus preventing the length variation member to be biased back into its first state, and allowing the roller to be demounted.

According to an aspect of the invention, the sloped portion extends up to or into the roller when the length variation member is in the first state. This ensures that the tool will contact said sloped portion when inserted in a gap adjacent the roller end.

To enhance the accessibility of the sloped portion even further, a plurality of sloped portions may be provided, distributed along the circumference of the length variation member. Alternatively, there may be one sloped portion extending around the entire circumference of the length variation member. In such case, no matter from what side the tool is inserted into the gap between the roller and holding member, it will always engage a or the sloped portion.

According to an aspect of the invention, the or each sloped portion may have a linear slope or a curved slope. The exact geometry of the slope will affect the required operating force and/or the way in which the length variation member displaces between its first and second state, so by choosing a specific slope geometry it is possible to obtain a desired displacement profile or operating force regime.

According to one embodiment of the invention, in the first state, the length variation member is arranged to be compressible such that it can be manipulated into the second state. The compressibility of the length variation member is to be understood as a property ensuring that it can be reduced in volume. For this embodiment of the invention, the bias of the length variation member to be in the first position consists in its resistance against being compressed. In order to give rise to the desired compressibility, the length variation member can for example be fully or partially produced using a foam casting process such that at least a part of the length variation member is foamed, leading to the property of being volume compressible.

According to another embodiment of the invention, the end bearing comprises a resilient member such as for instance a spring. The length variation member can be manipulated into the second state by being displaced in an axial direction of the end bearing against the force of the resilient member.

According to an aspect of the invention, the length variation member comprises at least one support portion with a bearing surface for resting on a counter surface of the holding member. Thanks to such dedicated cooperating surfaces the roller can be accurately and stably supported in mounted condition thereby enabling smooth rotation of the roller in its bearing.

Preferably, the or each bearing surface extends substantially parallel to a longitudinal axis of the length variation member or, in other words, is not sloped. This may help to prevent inadvertent demounting of the roller because all reaction forces exerted on the bearing surfaces by the counter surfaces will extend substantially perpendicular to said surfaces and hence will not generate any force component that could otherwise urge the length variation member towards its second state.

Preferably, the support portions are positioned at or near an outer end of the length variation member. The or each sloped portion may extend in axial direction between the support portions and the roller end. The or each sloped portion may further extend in circumferential direction between neighbouring support portions. Thanks to the latter feature, and despite the presence of the support portions, the tool may still be slid up to the very end of the length variation member, along said sloped portions so as to ensure that the length variation member is fully disengaged from the holding member as explained above.

The or each bearing surface may have a substantially flat configuration. Alternatively, the or each bearing surface may have a curved configuration. More particularly, the or each bearing surface may form part of an (imaginary) cylinder positioned concentrically with respect to a longitudinal central axis of the length variation member. The or each counter surface of the holding member can have a corresponding cylindrical or part cylindrical shape.

In further elaboration, the length variation member may comprise a sloped portion that extends along the entire circumference of the length variation member, near the outer end thereof, and at least three support portions that are distributed along the circumference of the length variation member, likewise near the outer end thereof, super imposed on the sloped portion. With such an embodiment the support portions alternate with the sloped portion, seen in a cross-sectional view, viewed from the end of the length variation member that faces away from the roller. Whereas the bearing surface of the support portions extend substantially parallel to the longitudinal axis of the length variation member, and thus can be in contact with one or more counter surfaces of the holding member, e.g. forming the inside surfaces of a cylindrical opening, the sloped end portion(s) do(es) not directly touch the inside surfaces of the holding member. Instead, there is a gap between the sloped end portion(s) and the inside surfaces of the holding member that increases gradually, in axial direction towards the end of the length variation member.

When embodiments of the invention comprise one or more support portions, it is advantageous when the length variation member further comprises a diverting portion, preferably one per support portion, for diverting a tool that approaches the support portion towards the or a sloped portion. As a result, the tool will not engage a support portion but instead will engage a diverting portion which will divert the tool towards a sloped end portion. Thus, the support portions do not block the length variation member from being manipulated into the second state. When a tool is inserted in a gap between the roller and the holding member it will always end up sliding along a sloped end portion, thus enabling successful manipulation of the length variation member into the second state.

According to a further aspect of the invention, each diverting portion extends in axial direction between a support portion (27) and the roller (11). Preferably, each diverting portion extends in one axial direction up to a support section. In the other axial direction, towards the roller, each diverting portion preferably extends equally far or beyond the at least one sloped portion. As such it is ensured that if a tool approaches the sloped portion at an inner end thereof facing the roller, where there are no support portions, the tool will still be diverted so that during further operation of the tool it can slide along the entire axial length of the sloped portion without ever hitting a support portion.

Each support portion pairs up with one diverting portion. Each pair consisting of a support portion and a diverting portion is intersected by a straight plane, which includes the longitudinal axis of the roller.

Additionally, the invention comprises embodiments, wherein the diverting portion comprises a radially outer edge extending substantially in the axial direction and comprising surfaces at either side of the edge, extending from the edge in the direction of a or the sloped portion. When a tool is driven towards the length variation member, for instance in a direction perpendicular to the axial direction, it thus first comes into contact with the edge of the diverting portion and subsequently slips to one of the sides where it is guided to the sloped portion. By rounding the edge, it can be further ensured that the tool will indeed be diverted to one of the sides of the diverting portion.

Further embodiments of the invention include that the sloped portion of the length variation member is rotatable around the axis of the end bearing. In some embodiments, it can only be rotated by a certain number of degrees such as for example 5 degrees or 25 degrees, in other embodiments, the sloped end portion is fully rotatable around the said axis. The invention comprises embodiments, for which the length variation member can be rotated by any given number of degrees between 0 and 180, only.

It is especially advantageous when the feature wherein the sloped portion is rotatable around the axis of the end bearing is combined with the feature of the end bearing comprising at least one diverting portion. When a tool comes into contact with the diverting portion, the sloped portion is then led to rotate, at least a bit, so that the tool can be slid further, past the diverting portion to meet the sloped portion. The tool thus does not need to be re-positioned. Accordingly, a user may introduce a credit card between the roller and the holding member without having to change the angle or the position at which he approaches the length variation member. In other words, the sloped portion is always rotated into a suited position such that a user can slide the tool up to and along the sloped portion.

According to another embodiment of the invention, the mounting system comprises a holding member for supporting the roller. The holding member can for instance be a bracket, or part of a cassette or the like. Preferably, the holding member is arranged to substantially overlap the length variation member, in particular the sloped portion(s) thereof, in mounted condition. As a result the roller end can extend close to the holding member, in mounted condition, resulting in a minimal gap between the two.

The end bearing may be a telescopic end bearing, comprising a hollow body which is at least partially shaped like a cylindrical tube having a slightly wider diameter than the length variation member, and the length variation member is slideably displaceable within the tube. The cylindrical tube can e.g. be arranged to fit into an end portion of a roller. This provides for an easy assembly mechanism, which is cost efficient in production.

According to another aspect of the invention, the sloped portion of the length variation member is rotatable between a first rotational position, in which the length variation member is locked against manipulations from the first into the second state, and a second rotational position, in which the length variation member is free to be manipulated. This mechanism of allowing the locking of the length variation member against manipulations provides for an especially good protection against accidental removal of the roller from a holding member.

Besides the mounting system described, the invention also comprises an end bearing for a mounting system according to any of the embodiments of the invention. Regarding the technical features of an end bearing according to the invention, reference is explicitly made at this point, to the above statements associated with end bearings as described in connection with a mounting system according to the invention.

Additional advantages and features of the present invention, that can be realized on their own or in combination with one or several features discussed above, in so far as the features do not contradict each other, will become apparent from the following description of preferred embodiments.

BRIEF DESCRIPTION OF THE FIGURES

The description is given with reference to the accompanying drawings, in which:

FIG. 6A shows a perspective view of a credit card-like tool being slid in between a roller and a holding member;

FIG. 6B shows a front sectional view of a credit card-like tool with its side edge engaging a sloped portion of a length variation member;

FIG. 6C shows an enlarged view of the credit card-like tool engaging the sloped portion of a length variation member;

DETAILED DESCRIPTION

Figure 1:
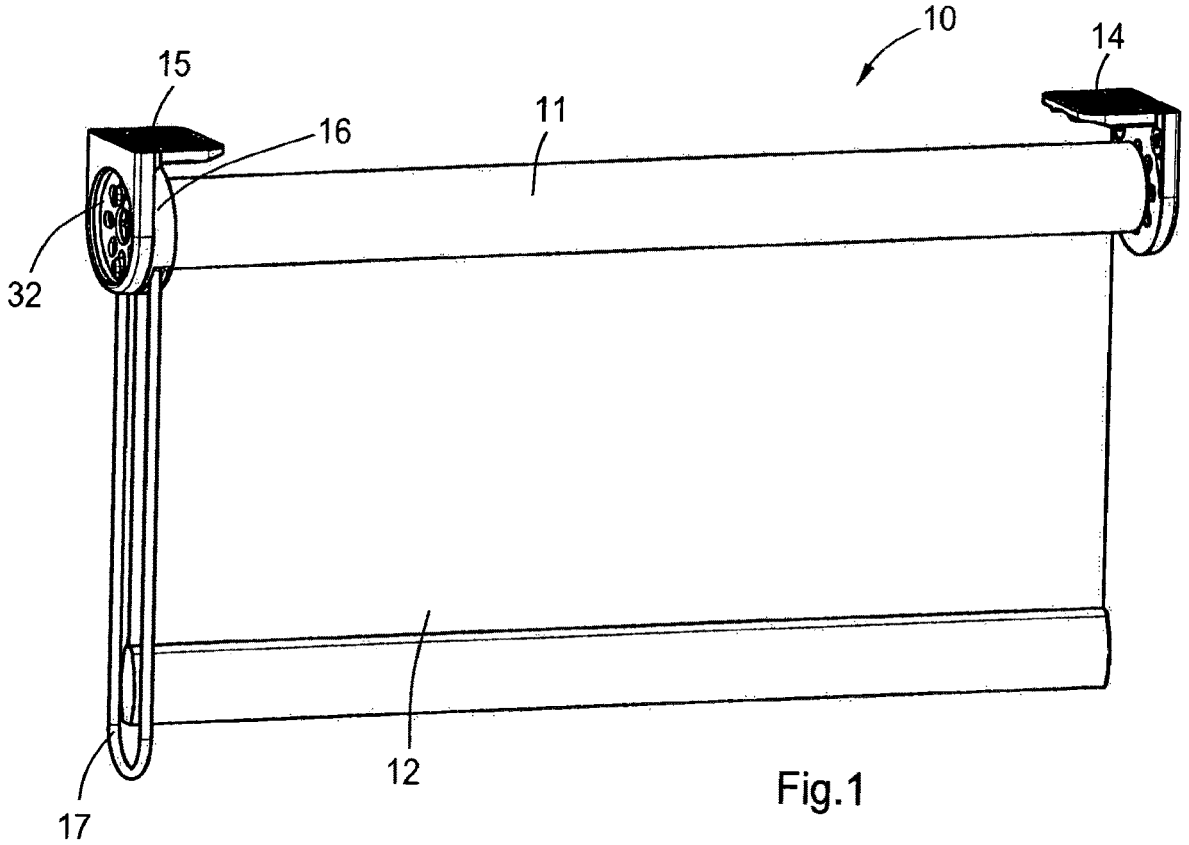
FIG. 1 shows an overall perspective view of a mounting system according to an embodiment of the invention.

FIG. 1 shows a perspective view of a mounting system 10 according to an embodiment of the invention. The system 10 comprises a roller 11 for winding and unwinding a cover material 12, and an end bearing 13 (not visible in FIG. 1) holdable by a holding member 14 for holding the roller 11. The holding member may for instance be part of a cassette or a bracket (as illustrated) that can be mounted to a wall or ceiling next to an architectural opening, such as a window or a door.

In the case of the embodiment of the system 10, shown in FIG. 1, the roller 11 is in fact held by two holding members 14, 15, one at either side. Both holding members 14, 15 comprise an opening 32 for holding the roller 11 in a rotatable way. At the end of the holding member 15, the embodiment of the system 10 shown in FIG. 1 further comprises an operating system 16 with a cord 17 for operating the roller 11 so as to unwind or wind up the cover material 12 to varying extents, depending on how much of the architectural opening a user would like to cover.

Figure 2A:
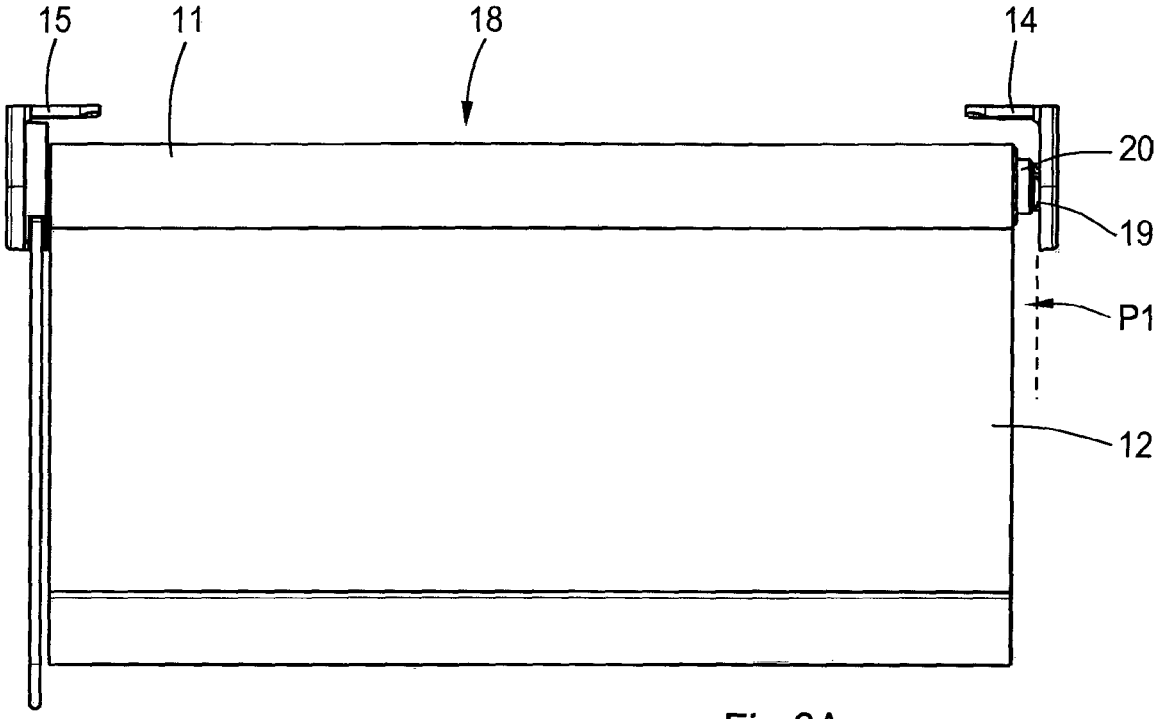
FIG. 2A shows a front view of a mounting system belonging to the prior art.
Figure 2B:
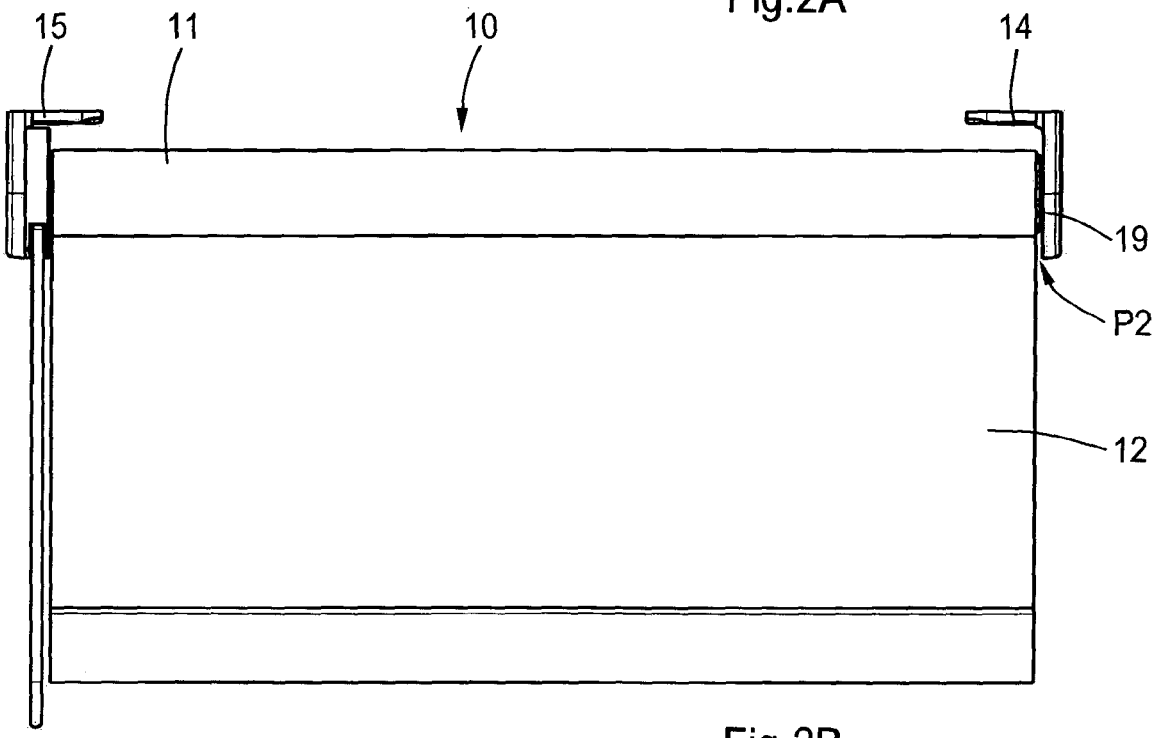
FIG. 2B shows a front view of a mounting system according to an embodiment of the invention.

FIGS. 2A and 2B offer a front view comparison between a mounting system 18, forming part of the state of the art, and a mounting system 10 according to an embodiment of the invention.

Both systems 10, 18 comprise a roller 11 held between two holding members 14, 15 for winding and unwinding a cover material 12. In both cases, the roller 11 comprises an axial end portion 19 that is provided with an end bearing.

As can further be seen in FIG. 2A an end bearing 20 according to the prior art is inserted between the roller 11 and the holding member 14. The end bearing 20 is telescopically compressible such that its axial length can be reduced. When a user of the system 18 wants to remove the roller 11 from a position in which it is held by the holding member 14, as shown in FIG. 2A, he can for example use a screw driver to telescopically compress the end bearing 20, thereby reducing the total length of roller 11 and end bearing 20, until the end bearing 20 can be removed from the holding member 14 (not shown in FIG. 2A).

As shown schematically in FIG. 2A, there is a substantial gap between the holding member 14 and the roller 11, indicated by the arrow P1. Thus, when the mounting system 18 is for example used to cover a window, a considerable light gap P1 will remain between the cover material 12 and the window side.

As indicated in FIG. 2B by arrow P2, there is no or only a neglectable gap between the holding member 14 and the roller 11, with the mounting system 10 according to an embodiment of the invention. Again, there is an end bearing 13 attached to the axial end portion 19 of the roller 11. The holding member 14 is arranged to substantially overlap a length variation member 21 of the end bearing 13, such that the roller 11 lies substantially adjacent to the holding member 14. Hereinafter, it will be explained in detail, why an architectural opening can be covered without leaving a relatively large gap, when using a mounting system 10 according to an embodiment of the invention.

Figure 3A:
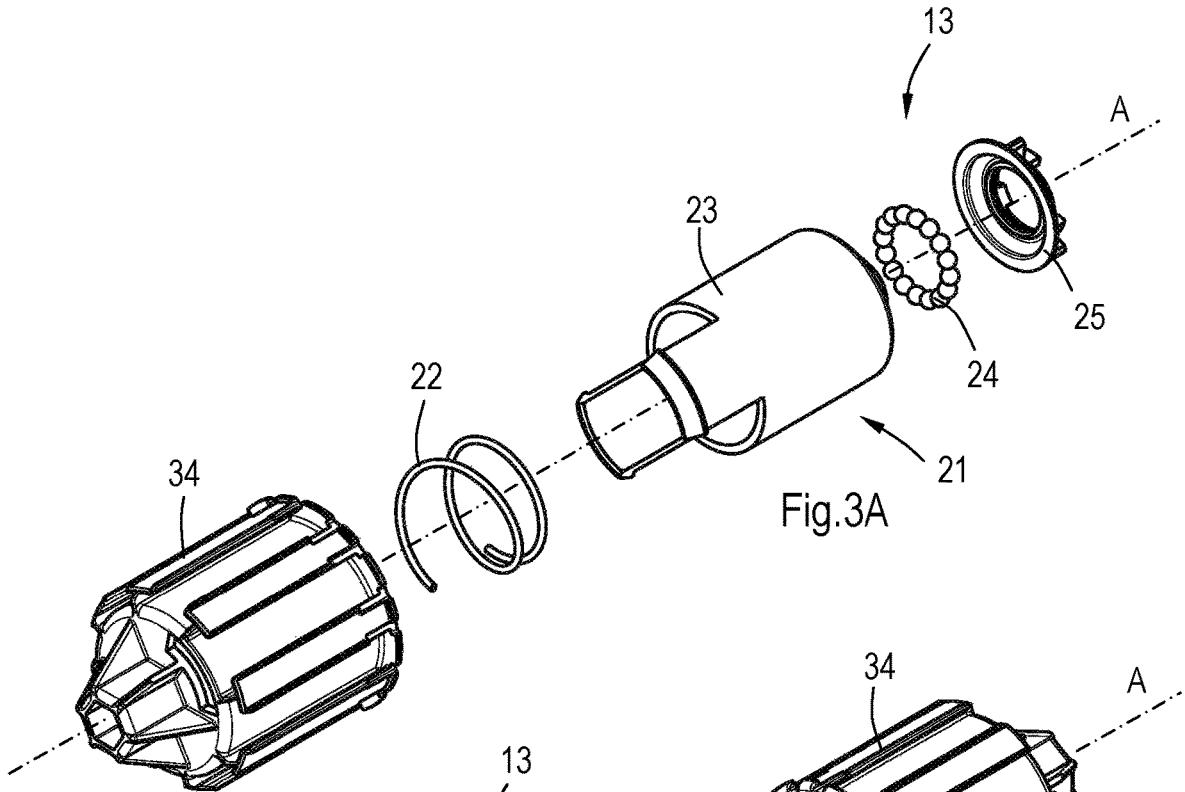
FIG. 3A shows a perspective exploded view of an end bearing according to an embodiment of the invention.
Figure 3B:
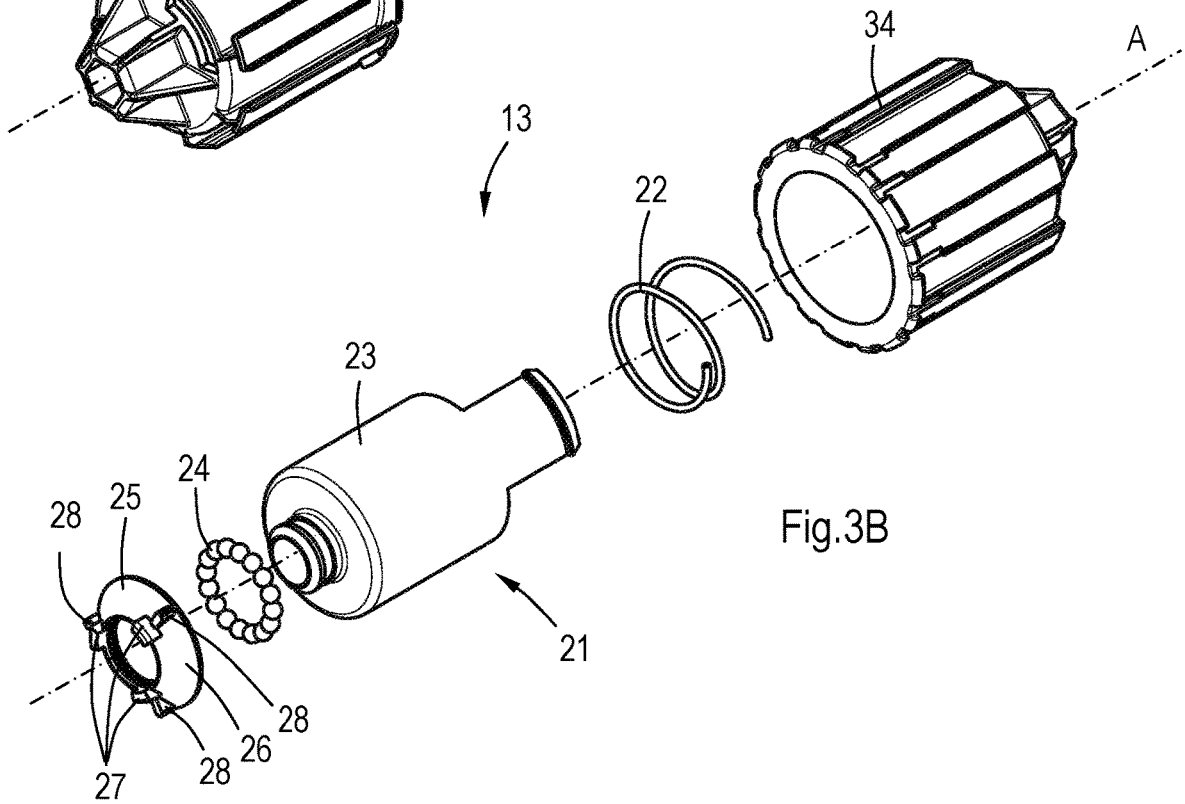
FIG. 3B shows a perspective exploded view of the end bearing of FIG. 3A from a different perspective.

FIGS. 3A and 3B show perspective exploded views of an end bearing 13 according to an embodiment of the invention, viewed from two different angles. The view is exploded with respect to the axial direction A of the end bearing 13. The shown embodiment of the end bearing 13 is also comprised in the roller cover mounting system 10 shown in FIGS. 1 and 2B.

The end bearing 13 comprises a base portion 34 that is connectable to the axial end portion 19 of the roller 11, shown in FIGS. 1, 2A and 2B. In the case of the embodiment of the end bearing 13 shown, the base portion 34 is arranged to be slid into an open end of the roller 11.

The end bearing 13 further comprises a length variation member 21 having a spring 22, a slideable member 23, an annular ball bearing 24 and an end portion 25 with a sloped portion 26. In the illustrated embodiment, the sloped portion extends around the full circumference of the end portion 25. More particularly, the sloped portion 26 is shaped like a truncated cone. The end portion 25 further comprises three supporting portions 27 that are superimposed on the sloped portion 26, along an outer edge thereof, and three diverting portions 28 that stand in one-to-one correspondence with the supporting portions 27.

When the end bearing 13 is used to hold a roller 11 with a holding member 14, only the end portion 25 protrudes from the base portion 34. In the assembled state of the end bearing 13, all the other shown parts in the exploded views of FIGS. 3A and 3B are hidden inside of the base portion 34. The base portion 34 is thus arranged as a hollow body and at least partially shaped like a cylindrical tube. Said other parts of the end bearing 13 are slideably displaceable within the tube.

The end portion 25 is arranged to be held by a holding member 14, by resting on a corresponding counter surface, e.g. the inside surface of a tubular-shaped opening, with bearing surfaces 31 (denoted and shown in more detail in FIG. 8B) provided on the three support portions 27. These bearing surfaces 31 extend substantially parallel to and are concentric with respect to the longitudinal central axis A of the length variation member 21.

When the end bearing 13 is assembled, the length variation member 21 is biased to be in a first state, in which the end portion 25 protrudes out of the base portion 34. The bias to be in the first state is, in the case of the embodiment shown, created by a force of the spring 22, pointing in the axial direction A, towards that end of the length variation member 21 at which the end portion 25 is positioned. The length variation member 21 can however be manipulated into a second state, in which its extension in the axial direction A is reduced, by pushing the end portion 25 in the axial direction A, against the force of the spring 22. When the latter is effected, the slideable member 23 is slid further into the base portion 34 in the axial direction A.

When the end bearing 13 is attached to a roller 11, and the end portion 25 is held by the holding member 14, only a tiny gap is left between the roller 11 and the holding member 14, as is schematically indicated in FIG. 2B by arrow P2. A user can slide a thin tool 20 such as for instance a credit card into said gap, and the tool will then come into contact with the front portion 25. Then, there are two possibilities. It can first come into contact with the sloped portion 26, in which case a force applied to the sloped portion 26, e.g. perpendicular to the centre axis of end bearing 13, will result in a force component pointing towards the roller 11. With this force component, the length variation member 21 can be displaced against the force of the spring 22, in the axial direction A, by increasingly sliding the tool 20 along the sloped portion 26, until the end of the end portion 25 is reached.

If however the tool 20 first comes into contact with a diverting portion 28, the tool 20 will be diverted to one of the two sides of the diverting portion 28, and a small rotation of the end portion 25 is triggered due to the fact that the end portion 25 is connected to the slideable member 23 by virtue of the annular ball bearing 24. This mechanism prevents the tool 20 from coming into contact with one of the support portions 27, as it is always diverted towards the sloped portion 26, prior to reaching a support portion 27. This ensures that the tool 20 always reaches the sloped portion 26.

The response to sliding-in a thin tool 20 between the end bearing 13 and the holding member 14 to remove the roller 11 from a holding member 14 will be explained more closely in the following, with references to the FIGS. 4A-7C.

Figure 4A:
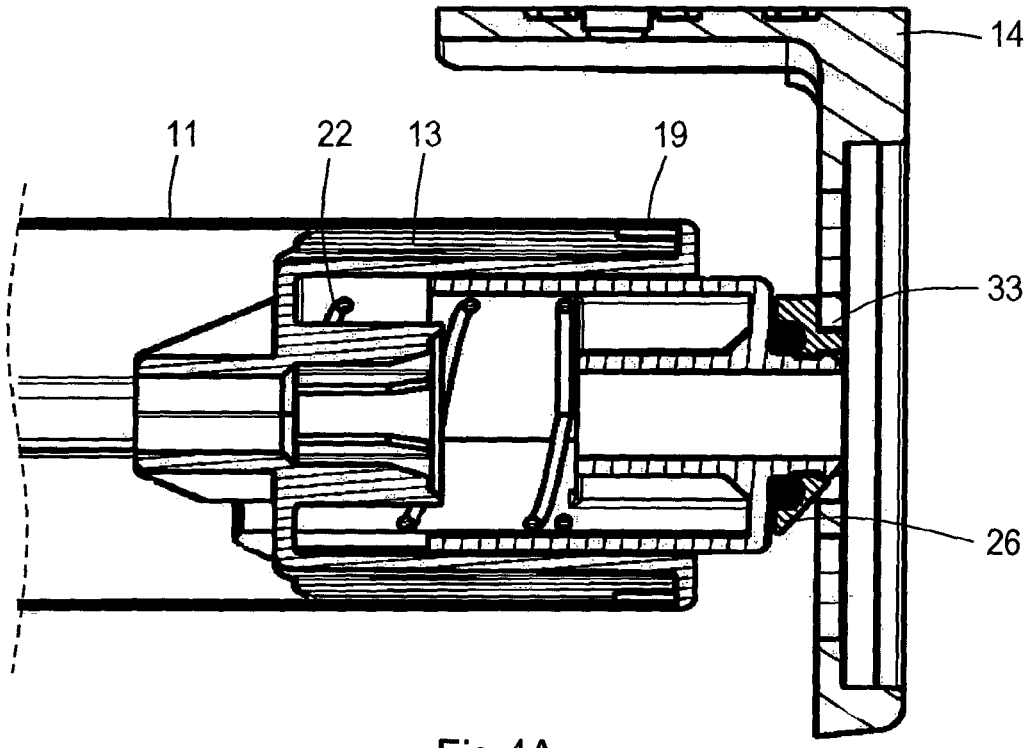
FIG. 4A shows an enlarged cross sectional view of an end bearing mounted to a holding member, with a gap.
Figure 4B:
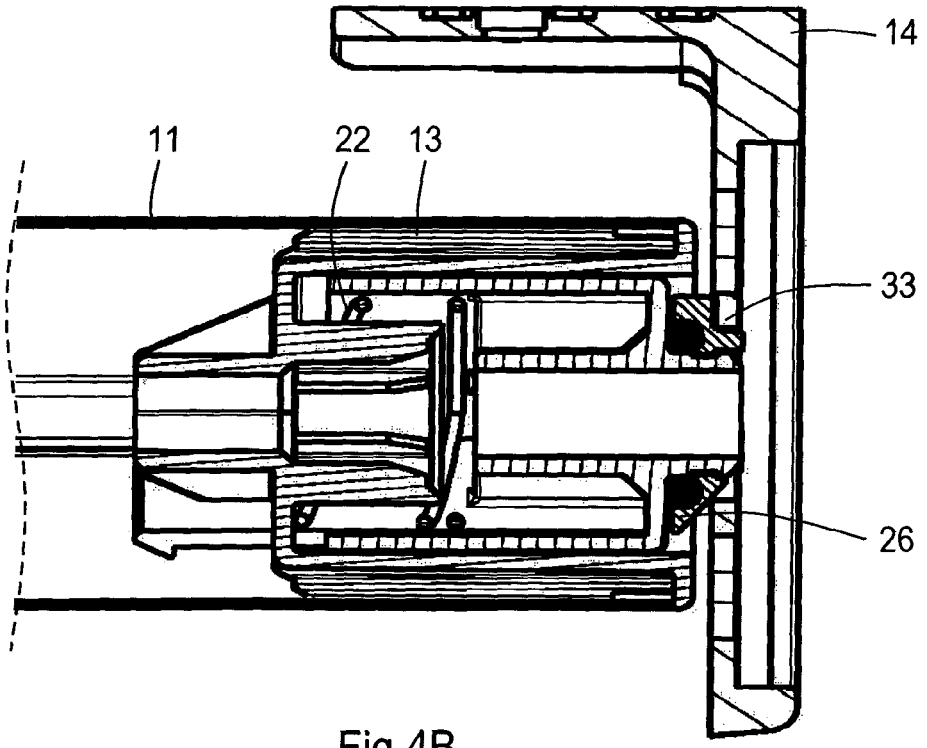
FIG. 4B shows an enlarged cross sectional view of an end bearing, mounted to a holding member, with a minimized gap.

FIG. 4A shows an embodiment of the end bearing 13, wherein the end bearing 13 is attached to an axial end portion 19 of the roller 11 at one end, and is held by a holding member 14 at the other end. The holding member 14 may comprise an opening 32 or indent 33 for holding the length variation member 21. In the embodiment shown in FIG. 4A, the length variation member 21 is biased into its first state. The roller 11 is thus held in a position, leaving a light gap as is present with mounting systems according to the state of the art. This illustrates how a gap can be deliberately left between the roller 11 and the holding member 14, if a user wants a gap. This means that the embodiment of the system 10 according to the invention is flexible in that it can also be used to reproduce the optical appearance of a system 18, according to the state of the art.

The length variation member 21 can be pressed into the end bearing 13, towards its second state. In the embodiment shown in FIG. 4B, the length variation member 21 has been pressed partly inward, so as to extend somewhere halfway between its first and second state. In such case, the mounting system according to an embodiment of the invention allows arranging the holding member 14 such that, when it holds the roller 11, it is positioned adjacent to the roller 11, thus leaving no or hardly any light gap in between of the roller 11 and the holding member 14. Nevertheless, a thin tool such as a credit card can be slid in between the roller 11 and the holding member 14, to reach the sloped portion 26. The sloped portion 26 extends in axial direction from a position adjacent to the roller 11 to the end of the length variation member 21. In circumferential direction it may extend along the entire circumference of the end portion 25, or along only part thereof. A credit card slid in between the roller 11 and the holding member 14 will come into contact with the sloped portion 26, allowing to generate a resulting force pointing to the left in FIGS. 4A and 4B, in the axial direction A, allowing to displace the length variation member 21 against the force of the spring 22, until the credit card can be slid up to the end of the end bearing 13, which then allows to remove the roller 11 from the holding member 14.

The sequence of steps necessary to remove the end bearing 13 and thus the roller 11 from the holding member 14 is illustrated with reference to the FIGS. 5A-7C. The first sequential step is illustrated by FIGS. 5A-5C, the second step by FIGS. 6A-6C, and the third step by FIGS. 7A-7C.

Figure 5A:
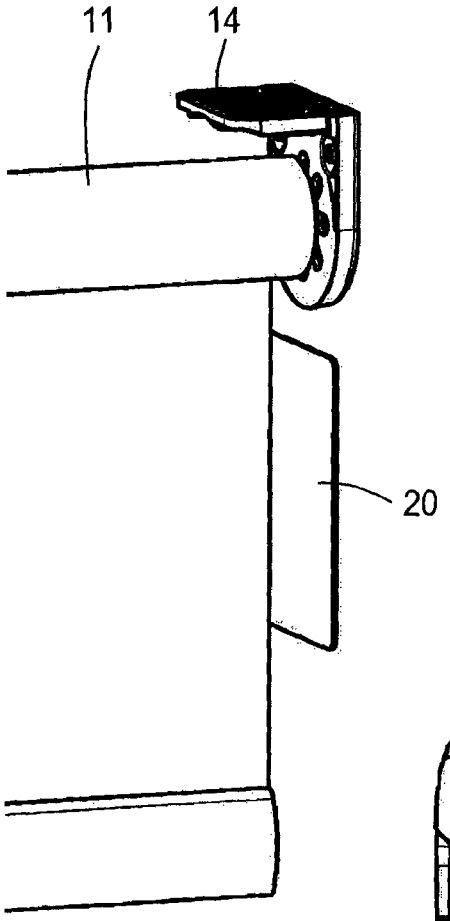
FIG. 5A shows a perspective view of a tool approaching an end bearing.
Figure 5C:
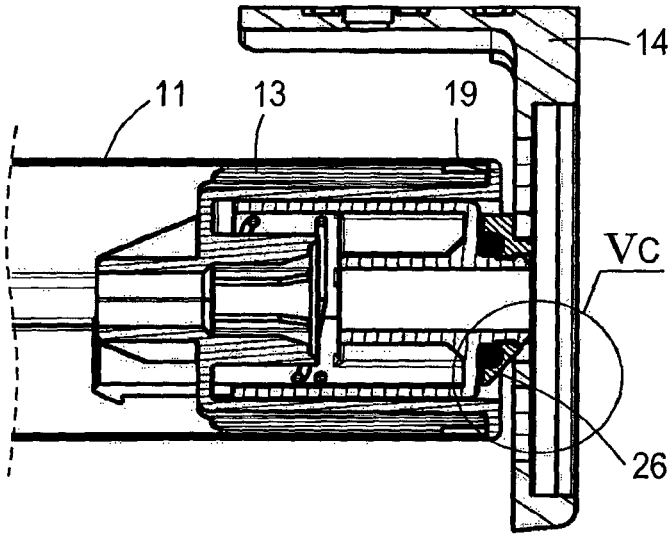
FIG. 5C shows an enlarged view of a sloped portion of a length variation member.
Figure 5C:
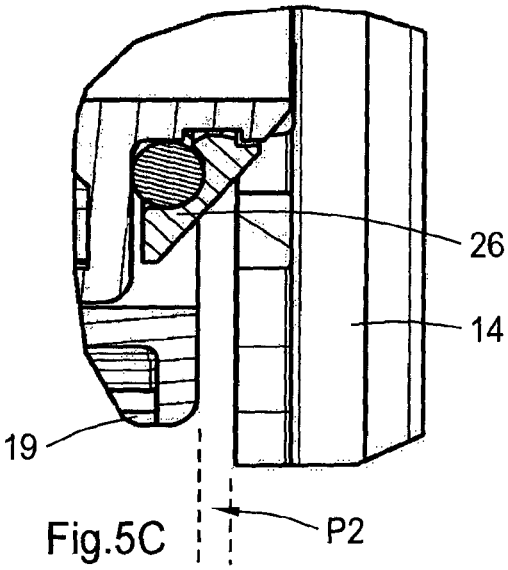

FIG. 5A shows a perspective view of a credit card-like tool 20 that is about to be slid in between of the roller 11 and the holding member 14.

Figure 5B:
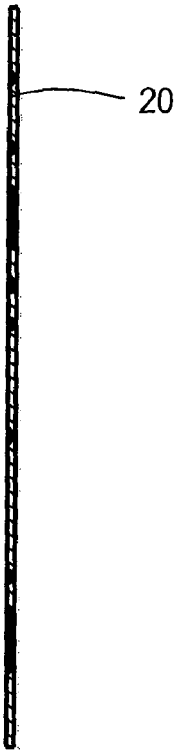
FIG. 5B shows a front sectional view of a tool approaching a sloped end portion of a length variation member.

FIG. 5B shows a front sectional view of a region surrounding the end bearing 13, the axial end portion 19 of the roller 11, the holding member 14, and the credit card 20 of FIG. 5A, that is about to be slid in between of the roller 11 and the holding member 14. When being slid in, the credit card 20 will eventually come into contact with the sloped portion 26. There is a small gap in between the base portion 34 of the end bearing 13 (see also FIGS. 3A and 3B) and the holding member 14, merely allowing for a thin object with a thickness of 2 mm or possibly even less. A card such as a credit card can be used. The small gap leaves space for the thin card 20 to be slid in between may have a width of about 2 mm, in the embodiment shown. There are however also embodiments, where said gap has a width of about 3 mm, and embodiments where the width is smaller and only amounts to about 1 mm or 0.75 mm. The invention for example also encompasses embodiments with gaps of the latter type with any gap having a width ranging from 0.5 mm to 3 mm.

FIG. 6A shows a state in which the credit card 20 is slid partially in between the roller 11 and the holding member 14. The credit card is touching the sloped portion 26 and is transmitting a force thereto, thereby moving the length variation member 21 in the direction of the arrow P3.

FIG. 6B shows a front sectional view of the arrangement shown in FIG. 6A. As illustrated, the credit card 20 is pressing onto the sloped portion 26 of the length variation member 21 with its edge, thereby transmitting a force. FIG. 6C shows an enlarged view of the credit card 20 being in contact with the sloped portion 26.

Figure 7A:
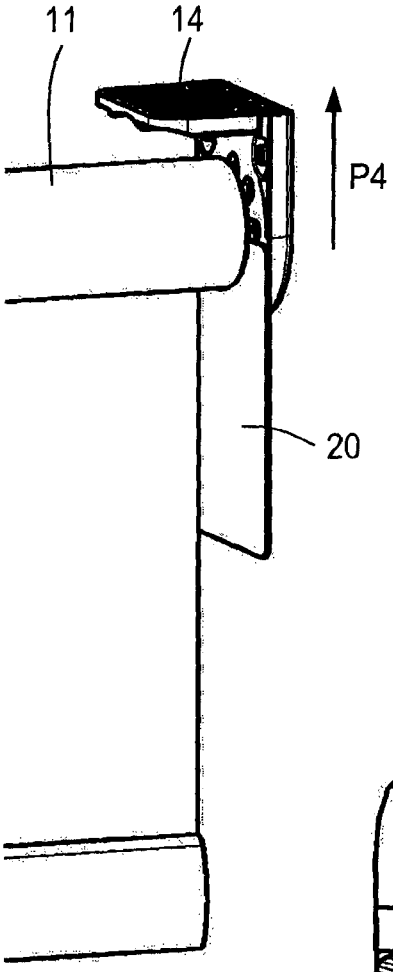
FIG. 7A shows a perspective view of a credit card-like tool being slid further in between a roller and a holding member.

FIG. 7A shows a third stage, in which the credit card 20 has been moved or pressed further up, indicated by the arrow P4, and further along the sloped portion 26, having now reached the end of the length variation member 21.

Figure 7C:
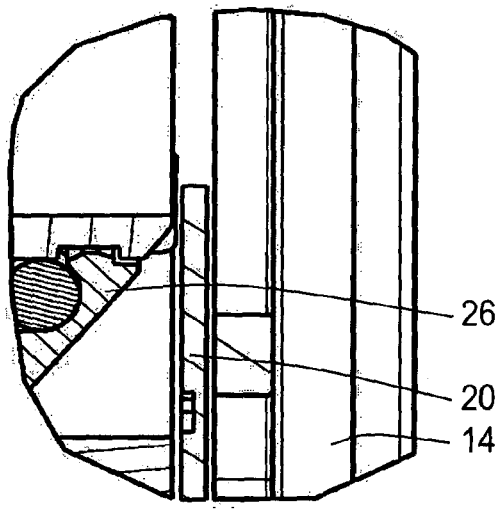
FIG. 7C shows an enlarged view of a credit card-like tool positioned between the holding member and the end of the length variation member.
Figure 7B:
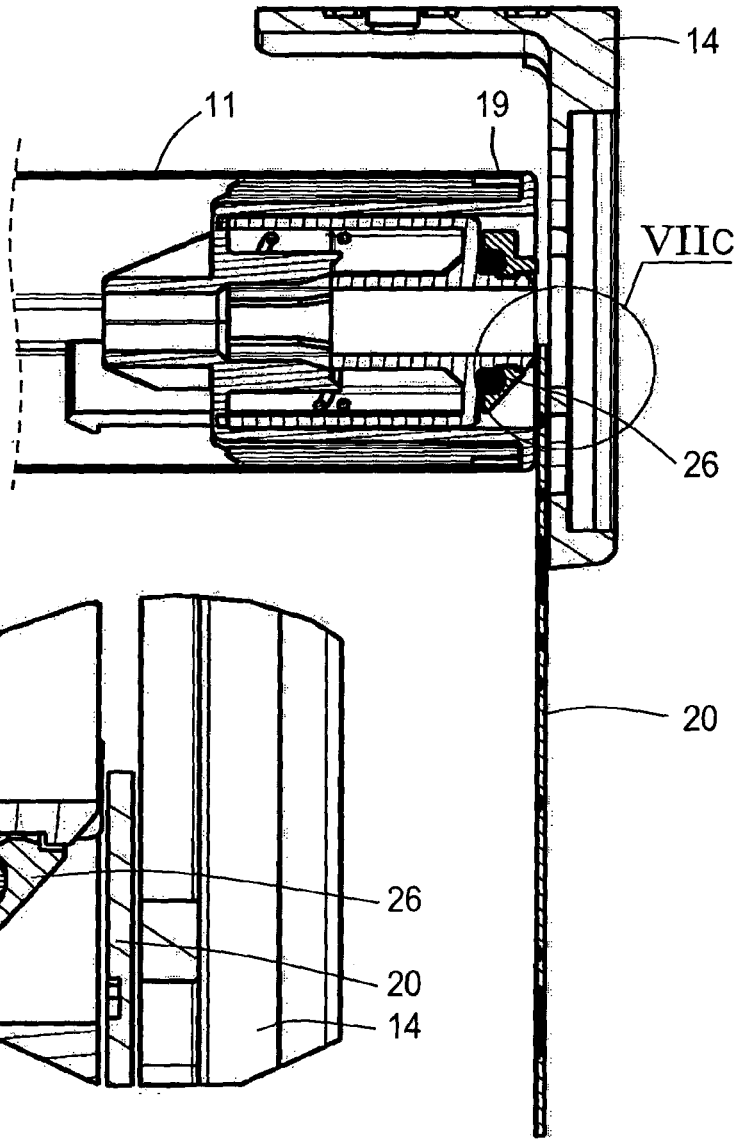
FIG. 7B shows a front sectional view of the credit card-like tool positioned between the holding member and the end of a length variation member, for removing the roller.

FIG. 7B shows that the credit card 20 has reached the end of the sloped portion 26 and thus the end of the entire end bearing 13, so that roller 11 can now be removed from the holding member 14. FIG. 7C shows the position of the credit card 20 in greater detail. In particular, it is to be seen that that the credit card has reached the end of the sloped portion 26 and is now arranged completely in between of the end bearing 13 and the holding member 14.

Figure 8A:
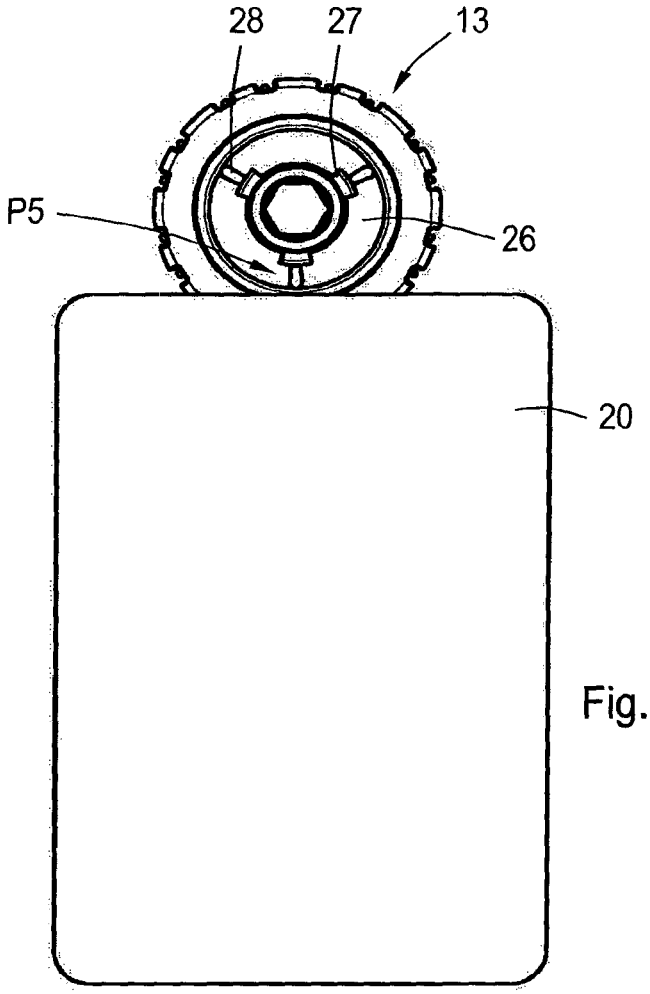
FIG. 8A shows a side view of a credit card tool coming into contact with a diverting portion of a length variation member.

FIG. 8A shows a side view of the credit card that has just hit a diverting portion 28 of the end bearing 13, viewed in the direction of the axis A, from the side, where a holding member 14 can be arranged. From this perspective, in a circumferential direction around the central axis A, sections of the sloped portion 26 of the end bearing 13 alternate with three support end portions 27 and diverting portions 28.

The diverting portions 28 can be interpreted as obstacles in the way of the support end portions 27. Therefore, a tool 20 will always hit a diverting portion 28 before reaching a support portion 27 and will therefore be diverted to the sloped portion 26. Furthermore, by virtue of the annular ball bearing 24, as described in more detail below, when the tool 20 comes into contact with a diverting portion 28, the length variation member 21 comprising the sloped portion 26, the diverting portions 28, as well as the support portions 27, is slightly rotated, so that someone using the tool 20 to remove the roller 11 does not have to change the approaching angle, when initially making contact with a diverting portion 28.

In order to enable the end portion 25 of the end bearing 13, including the sloped portion 26, the support portions 27 as well as the diverting portions 28, to be rotatable around the longitudinal axis A of the end bearing 13, the end portion 25 is mounted to the remaining parts of the end bearing 13 by virtue of the annular ball bearing 24.

Figure 8B:
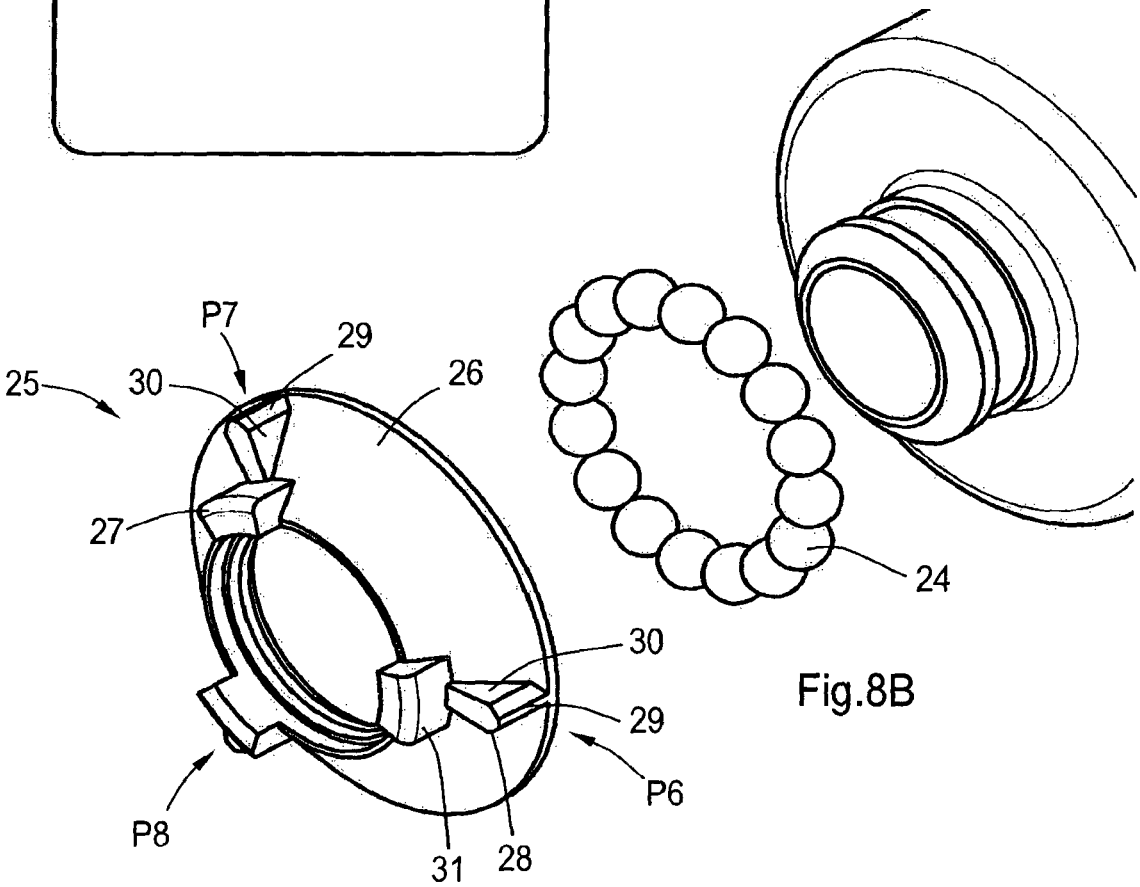
FIG. 8B shows a perspective exploded view of an end bearing with support portions and diverting portions.

FIG. 8B illustrates that the diverting portions 28 are provided equidistantly in circumferential direction of the sloped portion 26, at the positions indicated by the arrows P6, P7 and P8. They are positioned closer to the side of the end bearing 13 arranged for being connected with the roller 11 than to the respective support portion 27. The diverting portions 28 comprise a radially outer edge 29, extending substantially in the axial direction, and comprising surfaces 30 at both sides thereof, extending from the edges 29 to the sloped portion 26. By virtue of this shape, the diverting portion 28 ensures that a tool 20 such as a credit card, when being brought into contact at first with the edge 29, is diverted to reach the sloped portion 26.

Figure 9A:
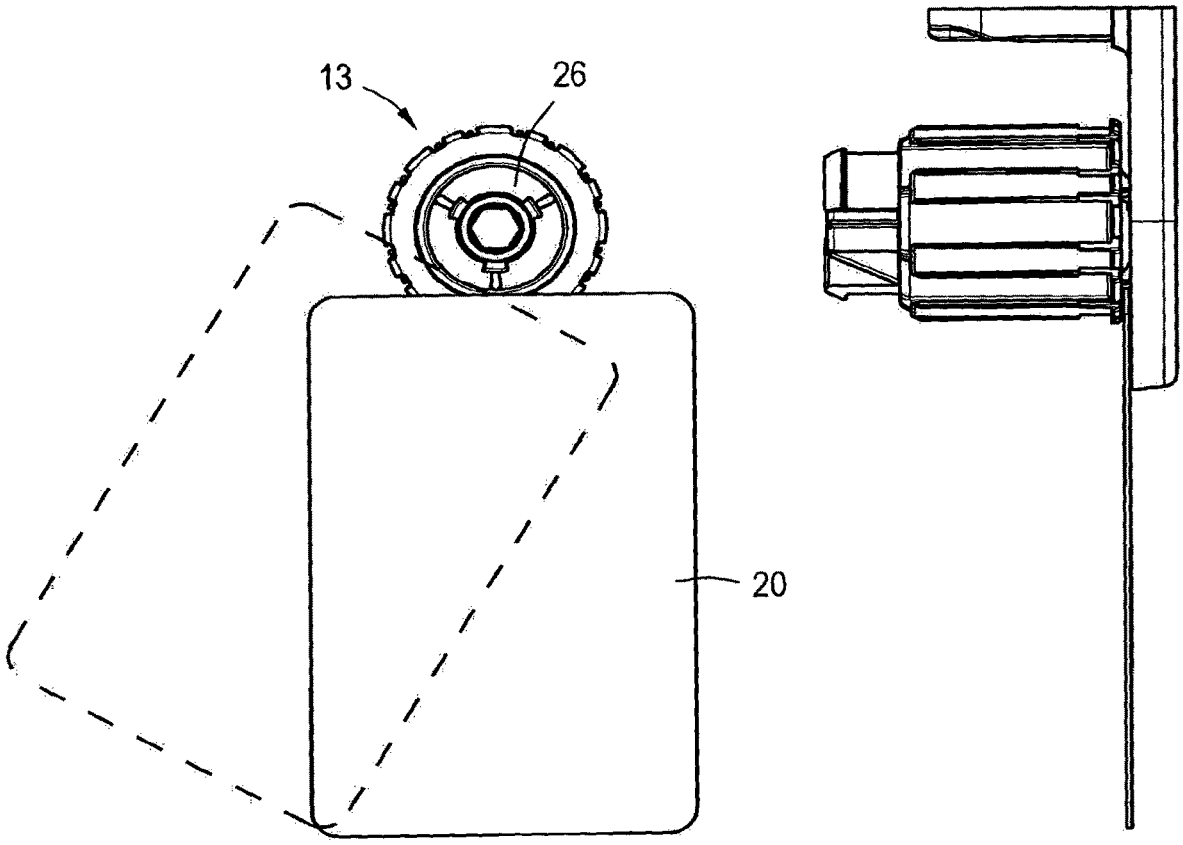
FIG. 9A shows a side view and a cross-sectional view of a credit card-like tool being diverted by a diverting portion.

FIG. 9A shows an embodiment of an end bearing 13, in side view and in cross-sectional view, wherein the sloped portion 26 is rotatable around the axis A of the end bearing 13, between a first rotational position (shown in FIG. 9A), in which the length variation member 21 may be locked against manipulations from its first into its second state, and a second rotational position (shown in FIG. 9B), in which the length variation member 21 is free to be manipulated from the first into the second state.

Figure 9B:
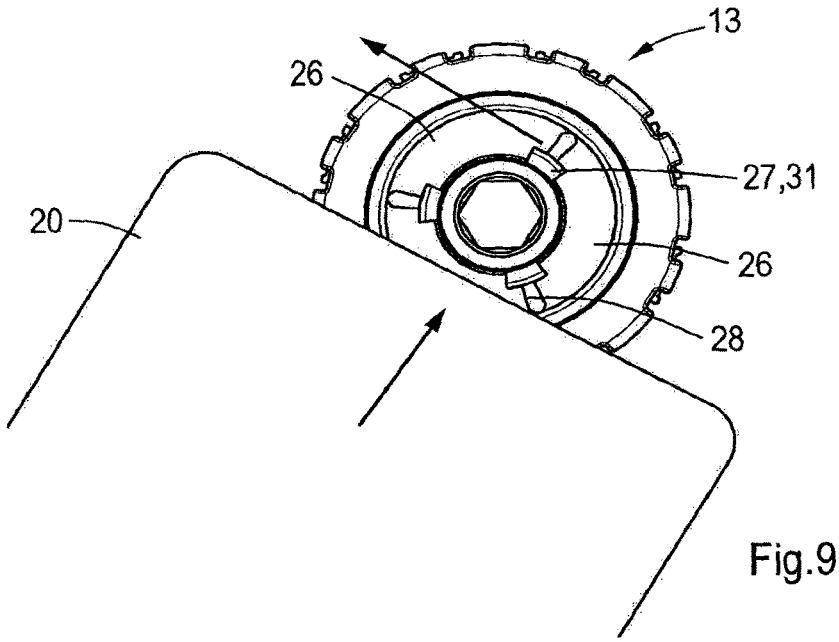
FIG. 9B shows an enlarged view of the credit card-like tool being diverted by the diverting portion.

Using this embodiment of the end bearing 13, the length variation member 21 can be unlocked by sliding a thin object such as a credit card 20 up to the end portion 25 of the end bearing 13, and to the diverting portion 28 in particular, followed by pivoting the credit card 20, as indicated by the arrows in FIG. 9B, such that the sloped portion 26 is rotated. The length variation member 21 can be locked by performing the contrary movement with the credit card 20.

The invention is not limited to the embodiments described. Numerous variations and modifications are understood to also fall within the framework of the invention. For example, instead of the end bearing comprising a spring as described, the length variation member can comprise another resilient member, e.g. of rubber, or can be arranged to be compressible such that it can be manipulated into the second state. To provide said compressibility, the length variation member can at least be partially produced by using a foaming method, so that at least a section of the length variation member is volume-compressible. Furthermore, the sloped portion could for example also have a substantially conical shape instead of a truncated conical shape. Many additional variations and modifications are possible and are understood to fall within the framework of the invention.

The invention claimed is:

1. A mounting system for an architectural covering, the mounting system comprising:

a roller for winding and unwinding a flexible member of the architectural covering; and an end bearing configured to be coupled to an axial end portion of the roller for rotatably mounting the roller to a holding member, the end bearing comprising a length variation member that is configured to be biased into a first state defining a bearing length allowing the roller to be held by the holding member, the length variation member being movable into a second state in which the bearing length is reduced such that the roller is removable from the holding member, the length variation member including an end portion configured to be located at least partially outside the roller when the length variation member is in the first state;

wherein:

the end portion includes an outer surface defining a sloped profile extending axially between a radially outer end of the outer surface and a radially inner end of the outer surface;

the end bearing further comprises at least one diverting portion projecting from the outer surface of the end portion at a location between the radially outer and inner ends of the outer surface of the end portion; and a radially outer edge of the at least one diverting portion is positioned proximal to the radially outer end of the outer surface.

2. The mounting system of claim 1, wherein the roller is configured to be removed from the holding member via application of a force to the end portion in a direction perpendicular to a longitudinal axis of the roller.

3. The mounting system of claim 2, wherein:

the system further comprises a tool configured to engage the end portion so as to apply the force to the end portion in the direction perpendicular to the longitudinal axis of the roller; and as the tool is being inserted radially between the roller and the holding member, the at least one diverting portion is configured to divert the tool away from a circumferential location of the at least one diverting portion and towards the sloped profile of the end portion.

4. The mounting system of claim 1, wherein the at least one diverting portion corresponds to one of a plurality of diverting portions projecting outwardly from the end portion relative to the sloped profile, the plurality of diverting portions being spaced apart circumferentially from one another around the end portion.

5. The mounting system of claim 1, wherein:

the end bearing further comprises at least one support portion projecting outwardly from the end portion relative to the sloped profile and being configured to engage a portion of the holding member when the roller is mounted relative to the holding member; and the at least one diverting portion is circumferentially aligned with the at least one support portion around the end portion.

6. The mounting system of claim 5, wherein the at least one diverting portion is configured to divert a tool away from the at least one support portion as the tool is inserted between the roller and the holding member.

7. The mounting system of claim 5, wherein the at least one diverting portion is positioned radially outwardly relative to the at least one support portion along the end portion.

8. The mounting system of claim 6, wherein the end portion is configured to rotate as the tool initially contacts the at least one diverting portion such that the tool is diverted away from the at least one support portion and towards the sloped profile of the end portion.

9. The mounting system of claim 6, wherein the tool is configured to initially contact the radially outer edge of the at least one diverting portion as the tool is inserted between the roller and the holding member.

10. The mounting system of claim 5, wherein the at least one support portion defines a bearing surface configured to engage a corresponding surface of the holding member.

11. The mounting system of claim 10, wherein the bearing surface extends substantially parallel to a longitudinal axis of the length variation member.

12. The mounting system of claim 2, wherein a diameter of the end portion continuously reduces as the end portion extends from the radially outer end of the outer surface to the radially inner end of the outer surface.

13. A mounting system for an architectural covering, the mounting system comprising:

a roller for winding and unwinding a flexible member of the architectural covering; and an end bearing configured to be coupled to an axial end portion of the roller for rotatably mounting the roller to a holding member, the end bearing comprising a length variation member that is configured to be biased into a first state defining a bearing length allowing the roller to be held by the holding member, the length variation member being movable into a second state in which the bearing length is reduced such that the roller is removable from the holding member, the length variation member including an end portion configured to be located at least partially outside the roller when the length variation member is in the first state;

wherein:

the end portion includes an outer surface defining a sloped profile extending axially between a radially outer end of the outer surface and a radially inner end of the outer surface;

the end bearing further comprises at least one support portion projecting axially from the outer surface of the end portion at a location between the radially outer and inner ends of the outer surface; and the at least one support portion is configured to engage a portion of the holding member when the roller is mounted relative to the holding member.

14. The mounting system of claim 13, wherein the at least one support portion defines a bearing surface configured to engage a corresponding surface of the holding member.

15. The mounting system of claim 14, wherein the bearing surface extends substantially parallel to a longitudinal axis of the length variation member.

16. The mounting system of claim 13, wherein the at least one support portion corresponds to one of a plurality of support portions projecting axially outwardly from the outer surface of the end portion, the plurality of support portions being spaced apart circumferentially from one another around the end portion.

17. The mounting system of claim 13, further comprising at least one diverting portion projecting axially from the end portion between the radially outer and inner ends of the outer surface of the end portion.

18. The mounting system of claim 17, wherein the at least one diverting portion is circumferentially aligned with the at least one support portion around the end portion and is positioned radially outwardly relative to the at least one support portion along the end portion.

19. The mounting system of claim 18, wherein the at least one diverting portion is configured to divert a tool away from the at least one support portion as the tool is inserted between the roller and the holding member.

20. The mounting system of claim 17, wherein:

the sloped profile of the end portion is configured such that a diameter of the end portion is reduced as the end portion extends from the radially outer end of the outer surface to the radially inner end of the outer surface; and the at least one support portion is positioned closer to the radially inner end of the outer surface of the end portion than the at least one diverting portion.

21. The mounting system of claim 20, wherein the diameter of the end portion continuously reduces as the end portion extends from the radially outer end of the outer surface to the radially inner end of the outer surface.

* * * * *